US005250492A

United States Patent [19]

Dotson et al.

[11] Patent Number: 5,250,492

[45] Date of Patent: Oct. 5, 1993

[54] COATINGS FOR USE WITH BUSINESS FORMS, SECURITY DOCUMENTS, OR SAFETY PAPER

[75] Inventors: Mark D. Dotson; Frank V. Parenti, both of Dayton, Ohio

[73] Assignee: The Standard Register Company, Dayton, Ohio

[21] Appl. No.: 666,194

[22] Filed: Mar. 7, 1991

[51] Int. Cl.[5] ..... B41M 5/132

[52] U.S. Cl. ..... 503/201; 503/206; 503/207; 503/209; 503/213; 503/214; 503/221; 503/225; 503/226

[58] Field of Search ..... 503/213, 215, 226, 201, 503/206, 207, 209, 214, 218, 219, 221, 225

[56] References Cited

U.S. PATENT DOCUMENTS

| | | | |
|---|---|---|---|
| 3,663,256 | 5/1972 | Miller et al. | 428/530 |
| 3,672,935 | 6/1972 | Miller et al. | 428/530 |
| 3,777,971 | 12/1973 | Steidinger | 93/63 M |
| 3,791,572 | 2/1974 | Gendron | 229/73 |
| 3,830,141 | 8/1974 | Steidinger | 93/63 M |
| 3,988,971 | 11/1976 | Steidinger | 93/63 M |
| 4,010,292 | 3/1977 | Shackle et al. | 427/150 |
| 4,081,127 | 3/1978 | Steidinger | 229/69 |
| 4,095,695 | 6/1978 | Steidinger | 229/69 |
| 4,097,619 | 6/1978 | Davis et al. | 427/150 |
| 4,112,138 | 9/1978 | Davis et al. | 427/150 |
| 4,120,445 | 10/1978 | Carrier et al. | 229/53 |
| 4,172,605 | 10/1979 | Welsch et al. | 428/201 |
| 4,199,618 | 4/1980 | Golden | 503/201 |
| 4,425,386 | 1/1984 | Chang | 427/150 |
| 4,488,646 | 12/1984 | McCorkle | 428/35 |
| 4,629,630 | 12/1986 | Devrient | 427/150 |
| 4,636,818 | 1/1987 | Jerabek | 503/213 |
| 4,729,506 | 3/1988 | Neubauer | 229/69 |
| 4,846,502 | 7/1989 | Chang et al. | 283/57 |
| 4,880,255 | 11/1989 | Zehner, Jr. | 282/11.5 A |

*Primary Examiner*—Pamela R. Schwartz

*Attorney, Agent, or Firm*—Killworth, Gottman, Hagan & Schaeff

[57] ABSTRACT

Carbonless coating compositions which can be printed onto one or more sheets of a business form or mailer to provide a visible image which is sharper and darker than previous coatings are provided. The compositions also find use on security documents and safety papers to provide a covert image on the document beneath information which may be subject to attempted alteration, such as the amount written on a check. The covert image becomes visible upon the application of pressure or solvent in the area coated to provide evidence of the attempted alteration. The self-contained composition includes an admixture of a color former, a color developer, and a plurality of pressure-rupturable microcapsules containing a solvent. Another solvent-sensitive composition includes an admixture of a color former and a color developer.

25 Claims, 5 Drawing Sheets

COATINGS FOR USE WITH BUSINESS FORMS, SECURITY DOCUMENTS, OR SAFETY PAPER

FIELD OF THE INVENTION

This invention relates to carbonless coatings which can be printed onto business forms, security documents, or safety paper and to a method for forming visible images on such business forms, security documents, or safety paper. More particularly, the invention relates to a business form, security document, or safety paper having a self-contained coating of an admixture of pressure-rupturable microcapsules of solvent, a color former and a color developer, printed thereon, and to a business form, security document, or safety paper having a coating of a color former and a color developer printed thereon.

BACKGROUND OF THE INVENTION

Multiple sheet business form assemblies which can be used as mailers are typically sealed envelopes which contain additional sheets therein on which information can be printed by impact printing processes. These mailers are frequently processed by computer-aided automated systems. The ability to print information selectively both on the inside and on the outside of the mailer simultaneously eliminates time-consuming separate printing of the sheets and envelopes, and manual stuffing, sealing, and stamping of individual envelopes. Mailers of this type are described in U.S. Pat. Nos. 3,777,971, 3,830,141, 3,988,971, 4,081,127, 4,095,965, 4,425,386, and 4,729,506.

In producing this type of mailer, confidential information, such as billing information, appears only on the inner layers of the mailer, while other information, such as the address, must appear on the outside. A variety of techniques have been proposed to accomplish this result.

One prior method involves printing all of the information on the outside of the mailer and onto one or more interior sheets The confidential information, which is to appear only on the inner layers, is then obscured by overprinting the confidential information on the exterior surface of the mailer with enough printed characters to make it unreadable. However, envelopes printed in this fashion have an undesirable appearance and require additional printing steps.

Another prior method involves the use of spot coatings of carbon ink on the bottom side of a top record sheet positioned over the mailer. Using this method, the address information can be printed on the front of the envelope by positioning it under the carbon spot, while confidential information can be printed onto the interior sheets. However, this system requires the use of expensive carbonizing bond paper to prevent penetration of the carbon ink. In addition, the top record sheet is typically thrown away because the information recorded there is usually stored on computer.

Another type of mailer uses a carbon ink spot coated carbon tissue which is placed between the top record sheet and the mailer. This eliminates the use of the expensive carbonizing bond paper, but the carbon tissue must be removed and thrown away prior to mailing.

Carbon ink spot coated carbonizing bond paper and carbon tissue sheets have sometimes been used inside the mailer. However, as discussed previously, these systems are expensive and, in addition, can cause smudging of the image receiving sheet.

Another system, is disclosed in U.S. Pat. No. 4,172,605, which uses a chemically reactive ribbon for a typewriter or a computer printer. The ribbon is coated with a solution which reacts with the coating on portions of the mailer to form images. This system requires direct contact between the ribbon and the mailer so that the chemical reaction can take place. In addition, the ribbons, which are relatively expensive, must be replaced frequently.

Still another system is disclosed in U.S. Pat. No. 4,425,386 to Chang. The mailer uses an autogenous, or self-contained, coating over part of the top sheet. The impact of the printer or typewriter causes the image to develop in the coated area. Other information printed at the same time but outside the coated area will not appear on the top sheet. The interior sheets of the mailer may have self-contained coatings or other printing systems so that the other information will appear on the appropriate sheets.

While the mailer described in the Chang patent solves some of the problems associated with mailers, it suffers from some serious drawbacks. The Chang patent teaches the use of a typical self-contained coating, such as that described in U.S. Pat. No. 4,010,292. Such a self-contained coating contains an encapsulated color former dissolved in oil and a dispersed color developer, such as phenolic resin or acid clay.

However, such self-contained coatings suffer from a number of, disadvantages. One problem with typical self-contained coatings is that dispersions of color developer usually must be applied as low solids content dispersions due to the poor rheology (i.e., high viscosity) of commercially available phenolic dispersions. The low solids level results in higher drying requirements, weak image development, and sheet distortion upon drying. Poor rheology also limits the method of applying these coatings to air knives or other full coat applicators, effectively preventing their use as spot coatings. In some cases, the addition of high levels of binder to the coating may permit it to be printed as a spot coating, but this results in poor image development. Background coloration is a major problem with conventional self-contained coatings. The existence of free color former in the coating remaining after the encapsulation process causes premature coloration of the background when it reacts with the dispersed color developer which is also present. Additional background coloration can be caused by the tendency of phenolic resin dispersions to yellow when exposed to air.

Another problem with typical self-contained coatings is the waste of expensive color forming dyes. Much of the dissolved dye remains in the capsules and is not available for reaction with the color developer when the capsules are ruptured. This requires the use of higher coating weights to achieve a sufficient surface concentration of dye and results in a significant waste of dye.

In its move toward automation, the U.S. Postal Service has issued specifications related to machine readability of mail. See Publication 25, United States Postal Service (1988). The specifications indicate that a print reflectance difference of at least 30% in the red portion of the optical spectrum is necessary for satisfactory reading of the post office bar codes. Print reflectance difference is defined as the difference between the reflectance of the background, i.e., the envelope, and the reflectance of the ink, multiplied by 100.

A mailer using a self-contained carbonless imaging system which passes this specification would be very desirable. However, because of the problems associated with the use of traditional self-contained coatings, prior art mailers have not been able to meet the postal specification because of weak image development.

Similar problems exist in producing covert (i.e., initially colorless) images on a security document or safety paper, such as checks and other negotiable instruments and certificates indicating title or authenticity, using conventional self-contained coatings. Some covert images are rub or abrasion sensitive so that if alteration of a document is attempted, such as erasure of a dollar amount on a check, the pressure causes the encapsulated dye to be released to react with the color developer to produce a colored indication of the attempted alteration.

However, premature coloration problems due to free color former present in the coating after encapsulation may result in a genuine document being dishonored as it may appear that the document has been altered. Further, yellowing of the dispersed color developer as it is exposed to air may also lead to confusion. The need to coat the document with a low solids coating composition leads to excessive drying requirements and potential cockling of the document substrate. Finally the use of encapsulated dyestuffs in solvents produces weak colored images, or alternatively, if higher coat weights are used to compensate for the weak color, results in higher costs because of the amount of dye required.

Other covert images are solvent sensitive. Commercially available solvent sensitive security paper is usually made by dispersing small particles of a solvent soluble, but water insoluble, dye into the headbox at the paper mill. As the paper is made, the solvent dye particles become entwined with the paper fibers and are virtually invisible. When an alteration is attempted by using a solvent which is capable of solvating the dye particle, the dye dissolves and creates a visible stain or speckle on the paper.

The appearance of these speckles is intended to alert the clerk or cashier that an attempted alteration has occurred and the document should be voided. However, in order for this system to be effective, the clerk must be aware that the speckles indicate attempted alteration and that they are not simply part of the document background. In addition, many of the solvent dyes used in the manufacture of the paper are not stable to ultraviolet light exposure. They can be faded from visibility by exposure to ultraviolet light either before or after solution.

Therefore, there is still a need in the art for multiple sheet business forms or mailers which can be printed with information on both the exterior and interior surfaces thereof. Further, there remains a need for a mailer which can produce imaged information which passes the postal specification for machine readability. There is also a need for compositions, self-contained as well as others, which can be printed by conventional printing equipment as a high solids content dispersions. Yet further, there remains a need in the art for compositions which can be printed as covert images on a security document or safety paper and which are not subject to the many shortcomings of the prior art compositions.

SUMMARY OF THE INVENTION

The present invention meets those needs by providing carbonless coating compositions which can be printed onto one or more sheets of a business form or mailer to provide a visible image which is more intense (i.e., darker) and sharper than previous coatings. The invention also finds use on security documents and safety papers to provide a covert image on the document beneath information which may be subject to attempted alteration, such as an amount written on a check. The covert image becomes visible upon the application of pressure or solvent in the area coated to provide evidence of the attempted alteration.

In accordance with one aspect of the present invention, a business form is provided containing at least one substrate having first and second major surfaces. The substrate includes a printable self-contained composition coated on at least a portion of one of its major surfaces comprising an admixture of a color former, a color developer, and a plurality of pressure-rupturable microcapsules containing a solvent for either or both of the color former and color developer. The self-contained coating composition is adapted to release the solvent from the microcapsules upon the impact of an imaging device, such as a printing stylus, a typewriter hammer, or a dot matrix print head to permit reaction of the color former and the color developer to form a visible image. Because the solvent is encapsulated and the composition can be printed as a high solids content coating, the color former and color developer react on contact when the solvent is released, and a darker, sharper image is formed. The image preferably has a print reflectance difference of at least 30% in the red portion of the optical spectrum in applications where it is required to be readable by automated postal equipment.

Any solvent which is capable of dissolving either the color former or the color developer can be used in the practice of the present invention. Examples of suitable solvents include dimethylazeolate, alkylated biphenyl compounds, and diisopropylnaphthalene. Diisopropylnaphthalene is the preferred solvent, as most commercially available color former and color developer compositions are readily soluble therein.

The self-contained composition also contains a color former and a color developer. The color former can be crystal violet lactone, the p-toluenesulfonate salt of Michler's hydrol or 4,4'-bis (diethylamino)benzhydrol, indolyl red, malachite green lactone, spiro phthalide xanthenes, such as 6'-(diethylamino)-3'-methyl-2'-(phenylamino)-spiro[isobenzofuran-(3H),9'-[9H]xanthen]-3-one, and rhodamine lactone. A preferred color former is 3-cyclohexyl-methyl-amino-6-methyl-7-anilino fluoran, commercially available under the designation PSD 150 from Nippon Soda Co. Ltd.

Color developers which may be used in the present invention include acid activated clays and phenolic resins, such as acetylated phenolic resins, salicylic acid-modified phenolic resins, and novalac-type phenolic resins. Phenolic resins are preferred, with those containing high levels of salicylic acid being especially preferred. An example of a phenolic resin with a high level of salicylic acid is HRJ 10126, commercially available from Schenectady Chemicals.

In order to prevent premature coloration of the background, the coating containing the color former and the color developer should be stabilized. In general, this is accomplished by adding a complexing agent, such as polyvinyl pyrrolidone, to the color former, and heating the mixture to a temperature of 60° C. for 15 to 30 min.

When 3-cyclohexyl-methyl-amino-6-methyl-7-anilino fluoran is used as the color former, it can be stabilized by complexing it with polyvinyl pyrrolidone by heating at 60° C. for 15 to 30 minutes. This is done before the admixing of the color developer and solvent-containing microcapsules into the composition. When the solvent-containing capsules are ruptured, a solvent, such as diisopropylnaphthalene, breaks down the complex and allows the reaction of the color former and the color developer to form the image.

The self-contained composition also preferably contains a film forming composition, such as a water soluble polymer, and proteins, such as casein and gelatins to insure adherence of the composition to the substrate. Preferred film formers utilized in the present invention include polyvinyl alcohol, polyvinyl pyrrolidone, and mixtures thereof. The use of a film former in the coating composition also results in a solution having a viscosity which allows the coating to be printed or spot-coated onto a substrate using conventional flexographic printing equipment. Additionally, the film former aids in maintaining the color former and color developer at the surface of the substrate so that the color reaction produces a dark, sharp image.

The self-contained composition may also include a non-volatile diluent which permits the solids content of the coating to be maintained at a high level. This results in easier drying because of the reduced water content of the coating, and little or no sheet distortion. Methyl glucoside is an example of a preferred non- volatile diluent.

The self-contained composition of the present invention, for use as an image-forming coating on business forms, preferably contains from about 20–50% encapsulated solvent, from about 3–25% color former, from about 5–20% color developer, from about 1–20% film former, and from about 1–20% non-volatile diluent, all percentages by weight. The composition is preferably applied at a coating weight of from about 1 to about 1.5 lb/ream (17×22×500 sheet ream).

In another embodiment of the invention, a business form is provided containing a plurality of sheets in a stacked relationship with the top sheet having the self-contained composition thereon. Such a multiple sheet business form is especially suitable for use as a mailer because the image formed from the coating meets postal specifications for machine readability.

With a multiple sheet business form or mailer, there may be one or more additional sheets having self-contained coating compositions on at least a portion of one of their major surfaces, which coating compositions may be non-coextensive with the coating composition on the top sheet. In this way, information may be selectively printed on the inner layers of the form or mailer. When the imaging device strikes the outer layer of the form or mailer, an image is formed only on those layers within the construction which have a self-contained coating composition at that location.

The imaging device may either contact the coating directly, or a non-reactive shielding means may be placed between the imaging device and the self-contained coating to reduce the impact of the imaging device on upper surface of the substrate. The optional non-reactive shielding means may take the form of an uninked ribbon which prevents the imaging device from embossing the surface of the business form. The imaging device can be used without a ribbon with the self-contained coating because the images are formed by the reaction within the self-contained coating rather than by the use of ink in a ribbon.

In another embodiment of the invention, the business form may contain a substrate having first and second major surfaces with a composition coated on at least a portion of one of those surfaces comprising an admixture of color former and color developer. The coating is adapted to allow the reaction of the color former and the color developer to form a visible image when a solvent is transferred from the print ribbon of an imaging device to the coating. The image formed is sharp and dark because the composition is printed as a high solids content coating, and the color reaction occurs only when the solvent is transferred from the ribbon. The image preferably has a print reflectance difference of at least 30% in the red portion of the optical spectrum so that the form can be read by automated postal systems.

The coating contains the same type of color formers and color developers as discussed in relation to the self-contained coating. The coating may also contain the same types of film formers and non-volatile diluents discussed above.

Any solvents which will solubilize either the color former or the color developer can be used in the print ribbon. However, the selection of solvents having a low vapor pressure is preferred to provide for longevity in the exposed print ribbon. Among solvents suitable for this use are diisopropylnaphthalene, available from Kreha under the designation KMC-113, dimethylazeolate, N-ethyl-o,p-toluenesulfonamide, available from Monsanto Chemical Company under the trade name Santicizer-8, methyl linoleate, dipropylene glycol dibenzoate, available from Velsicol Chemical Company under the trade name Benzo Flex, linear alkyl benzene with $C_{13}$ to $C_{15}$ alkyl groups, available from from Monsanto under the designation Alkylate 215, alkyl biphenyl, available from Koch Chemical Co. under the designation Suresol 330, and dibutylethyl adipate. Two or more of these solvents may be blended together to take advantage of the desirable properties of the solvents. The resulting ribbons have the advantage of being colorless and thus do not cause smudges.

In yet another embodiment of the invention, the business form may contain a plurality of sheets in a stacked relationship with the coated substrate being the top sheet in the stack. This multiple sheet business form can also be used as a mailer because the indicia formed thereon meet the postal specification for machine readability. Any additional sheets in the stack on which it is desired to print information may utilize conventional self-contained compositions or the self-contained composition of the present invention since only the top sheet contacts the solvent in the print ribbon.

Another embodiment of the invention involves a multiple sheet business form containing a plurality of sheets in a stacked relationship. At least one sheet has a first coating on at least a portion of its lower surface (CB coating) comprising a plurality of pressure-rupturable microcapsules containing solvent. The sheet immediately beneath the at least one sheet has a second coating on at least a portion of its upper surface (CF coating) of an admixture of a color former and a color developer. The color former and the color developer react to form a visible image upon the impact of an imaging device by rupturing the microcapsules on the back side of the upper sheet to release solvent onto the surface of the sheet immediately beneath it. This initiates the reaction between the color former and the color developer. A dark, sharp image is formed because the composition can be printed as a high solids content coating and the reaction occurs only when the solvent is transferred from the sheet above. The image preferably has a print reflectance difference of at least 30% in the red portion of the optical spectrum.

The CF coating contains the same type of color formers and color developers as discussed in relation to the self-contained coating. Both coatings may also contain the same types of film formers and non-volatile diluents discussed above.

Another embodiment of the present invention provides a security document having a substrate with first and second major surfaces and bearing a covert image or a continuous coating on one or both of those surfaces. The covert image on the substrate surface is formed from a printable self-contained composition comprising an admixture of a color former, a color developer, and a plurality of pressure-rupturable microcapsules containing solvent. The self-contained composition is adapted to release the solvent from the microcapsules upon the application of pressure, allowing reaction of the color former and the color developer to form a visible color. The self-contained composition is also adapted to allow reaction of the color former and the color developer to form a visible color upon the application of additional solvent to the self-contained coating. The visible color which forms provides evidence of attempted alteration, either by erasure or by the application of a solvent, of the area covered by the self-contained composition. The color will form an image or a non-distinct smudge, depending on whether the self-contained composition is applied as an image or an overall coating.

The self-contained composition may be applied to selected areas of the security document either as images or indicia such as warning words or simply by coating an area with the composition. The composition will show attempted alteration of the document by the use of many solvents in the following classes: alcohols, acetates, ketones, chlorinated hydrocarbons, furans, mineral acids, and some organic acids. In addition, the self-contained coating may include a hypochlorite sensitive compound which forms a color upon exposure to ink eradicators to further improve the range of security against unauthorized alteration of the document.

Another embodiment of the invention provides a security document in the form of a safety paper. The safety paper may bear a series of covert images on the document substrate, or it may have the self-contained composition covering substantially the entire surface of the substrate so that any attempted erasures or application of solvents will be apparent.

Yet another embodiment of the present invention provides a solvent-sensitive security document having a substrate with first and second major surfaces and bearing a covert image on one or both of those surfaces. The covert image on the substrate surface comprises a coating of an admixture of a color former and a color developer. This coating is adapted to allow reaction of the color former and the color developer to form a visible image upon the application of a solvent to the coating. The visible image provides evidence of use of solvents in an attempted alteration of the area covered by the coating. This coating will provide evidence only of attempted solvent alteration, not of attempted erasure, unlike the security document using the self-contained coating containing microcapsules discussed above.

The coating may be applied to selected areas of the security document either as images such as warning words or simply covering substantially the entire area. It will show attempted alteration of the document by the use of many solvents in the following classes: alcohols, acetates, ketones, chlorinated hydrocarbons, furans, mineral acids, and some organic acids. In addition, the coating may include a hypochlorite sensitive compound which forms a color upon exposure to ink eradicators to further improve the range of security against unauthorized alteration of the document.

The present invention also provides a method for forming visible images on a business form having a self-contained composition on at least a portion of one of its major surfaces, the composition comprising an admixture of a color former, a color developer, and a plurality of pressure-rupturable microcapsules containing a solvent. The method includes the step of contacting the surface of the business form with an imaging device to provide a visible image in the self-contained coating by rupturing the microcapsules to release the solvent and causing reaction ,of the color former with the color developer.

In an alternative form of the method, the business form further comprises a plurality of sheets in a stacked relationship with at least one underlying sheet having a second self-contained composition on its upper surface. The composition comprises an admixture of a color former, a color developer, and a plurality of pressure-rupturable microcapsules containing a solvent, the first and second self-contained compositions being non-coextensive.

The imaging device may directly contact the self-contained composition, or, alternatively, it may indirectly contact the self-contained composition by placing a non-reactive shielding means between the imaging device and the self-contained composition to reduce the impact of the imaging device on the upper surface of the substrate.

The present invention also provides a method for forming visible images on a business form having a composition on at least a portion of one of its major surfaces comprising an admixture of a color former and a color developer. The method includes the step of contacting the surface of the business form with an imaging device thereby providing a visible image in the composition by transferring a solvent from a print ribbon allowing reaction of the color former and the color developer.

Accordingly, it is an object of the present invention to provide a multiple sheet business form or mailer which can be printed with information on both the exterior and interior surfaces thereof. It is another object of the invention to provide a mailer which produces imaged information which passes postal specifications for machine readability. Another object of the invention is to provide compositions, both self-contained and otherwise, which can be printed by conventional printing equipment as high solids content dispersions. Still another object of the invention is to provide improved compositions which can be printed as covert images on security documents and safety papers. These and other objects and advantages of the present invention will become apparent from the following detailed description, the accompanying drawings, and the appended claims.

DETAILED DESCRIPTION OF THE PREFERRED EMBODIMENTS

Figure 1:
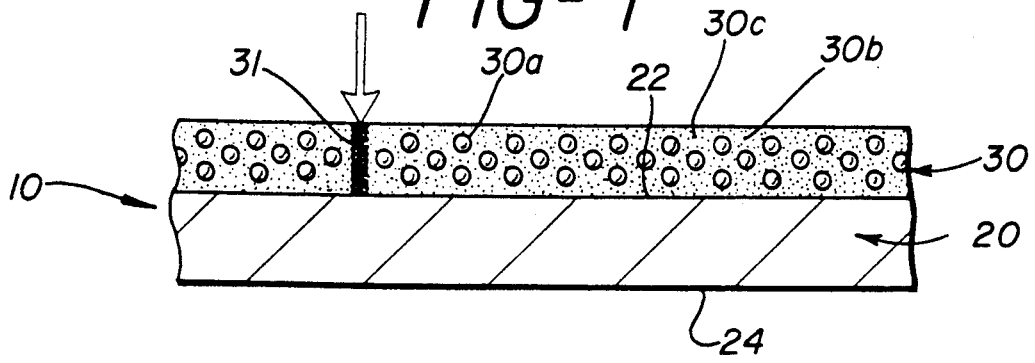
FIG. 1 is a fragmentary sectional view of one embodiment of the business form of the present invention.

Referring to FIG. 1, there is shown a typical business form 10 made in accordance with the present invention. Form 10 includes a substrate 20, typically of paper, having first 22 and second 24 major surfaces. The substrate 20 has on its first surface 22 a self-contained coating composition 30 comprising an admixture of a color former 30*a*, a color developer 30*b*, and a plurality of pressure-rupturable microcapsules 30*c* containing a solvent. The coating may be substantially continuous or cover only a portion of the substrate rather than the entire substrate. Self-contained coating composition 30, along with other coatings (not shown) which may be provided on first surface 22 of substrate 20, may cover substantially less than the entire first surface 22 of substrate 20.

When an imaging device, indicated by the arrow, applies pressure, to first surface 22 of substrate 20, visible images 31 are formed only in those areas impacted by the imaging device and covered by coating 30. When the imaging device applies pressure to an area outside coating 30, no image is formed on first surface 22 of substrate 20. Because coating 30 is self-contained, the images on the first surface 22 of substrate 20 may be formed without the use of a ribbon, or with the use of a ribbon containing no chromogen or other image-forming material.

Figure 2:
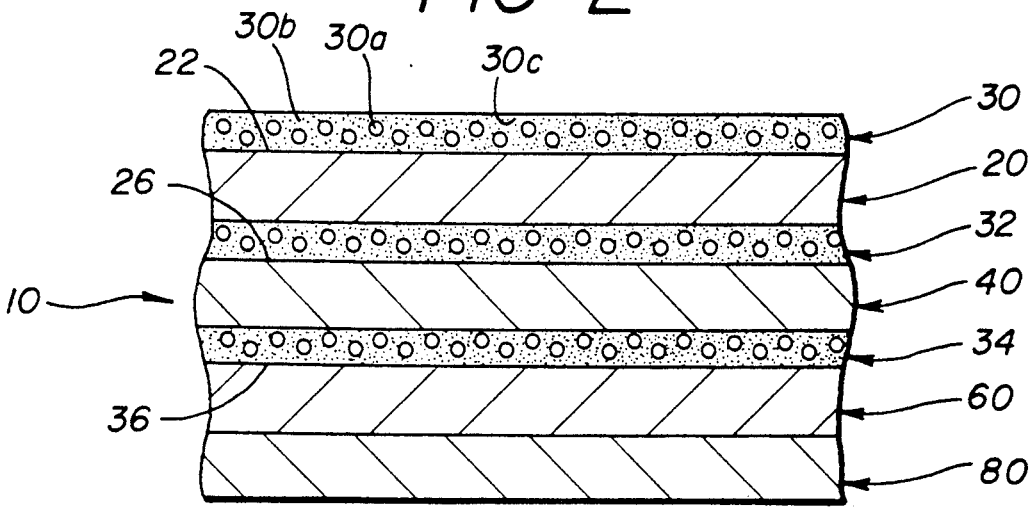
FIG. 2 is a fragmentary sectional view of one embodiment of the multiple sheet business form of the present invention.

FIG. 2 illustrates an alternative embodiment in which the business form contains a plurality of sheets in a stacked relationship which may be formed into a mailer. FIG. 2 shows an example having four sheets, 20, 40, 60, and 80.

The top sheet 20 includes a self-contained coating composition 30 on at least its first surface 22. Coating 30 may be spot coated or printed onto selected portions of first surface 22, or it may be coated over substantially the entire surface thereof. The second sheet 40 also has a self-contained coating composition 32 which can be spot coated or printed on selected portions or cover substantially the entire surface 26 of sheet 40. Coatings 30 and 32 need not be coextensive. In this way, an imaging device contacting the upper surface 22 of sheet 20 outside of the area covered by coating 30 will not form an image on sheet 20, but will form an image on sheet 40 if the impact occurs within the area covered by self-contained coating 32. By selectively printing or spot coating the surfaces of sheets 20, 40 and 60, all printing can be done in a single pass, with the imaging device directly contacting only the upper surface 22 of sheet 20 and images selectively formed on sheet 20 only, on sheet 40 only, on sheet 60 only, or on a combination of sheets 20, 40, and 60, as desired.

Sheet 60 may also have a self-contained coating 34 on surface 36 to form selected images when the imaging device impacts the upper surface 22 of sheet 20. Sheet 80 may comprise a backing sheet which may itself include self-contained coatings or not as desired.

The self-contained coating composition of the present invention is produced by first encapsulating a selected solvent for either or both of the color former and color developer compositions in pressure-rupturable microcapsules. The microcapsules may be prepared using the techniques taught in U.S. Pat. Nos. 4,729,729 and 4,898,780, the disclosures of which are incorporated by reference, or by any other technique commonly used in the art including coascervation, melamine/formaldehyde, or polyurea. Typical capsule sizes are about 3–7 μm and are preferably about 4–5 μm.

As is conventional in the art, the capsule wall material is designed to resist normal handling pressures, but to rupture upon the impact of a printing device or upon an attempted erasure of printed matter over the capsules.

The capsules containing solvent are then mixed with a color former, preferably a dispersion of color former. The color former dispersion is preferably made by mixing together in an aqueous solution, the color former, a film former, and optionally a defoamer. These materials are mixed together until the average particle size of the color former is between 2 and 5 microns.

Finally, the color developer is added, forming a high solids content dispersion. Additional components may be added to the coating. These may include defoamers, non-volatile diluents, film formers, viscosity reducers, stilting materials, and hypochlorite sensitive compounds. Stilting materials include particles of inert material such as starch which are larger than the capsules and which protrude above the surface of the composition to prevent accidental breakage of the capsules.

Solvents suitable for use in the present invention include those which are capable of dissolving either the color former or the color developer. Examples of useful solvents include dimethylazeolate, alkylated biphenyl compounds, and diisopropylnaphthalene. Diisopropylnaphthalene is the preferred solvent. Encapsulated diisopropylnaphthalene is commercially available under the designation Micronal SE 0201 from BASF.

The self-contained coating composition also contains a color former and a color developer. Color developers which may be used in the present invention include acid activated clays and phenolic resins, such as acetylated phenolic resins, salicylic acid-modified phenolic resins, and novalac-type phenolic resins. Phenolic resins are preferred, with those containing high levels of salicylic acid being especially preferred. An example of a phenolic resin with a high level of salicylic acid is commercially available from Schenectady Chemicals under the designation HRJ 10126.

The color former may be crystal violet lactone, the p-toluenesulfon ate salt of Michler's hydrol or 4,4'-bis (diethylamino)benzhydrol, indolyl red, malachite green lactone, spiro phthalide xanthenes, such as 6'-(diethylamino)-3'-methyl-2'-(phenylamino)-spiro[isobenzofuran-(3H),9'-[9H]xanthen]-3-one, and rhodamine lactone. A preferred color former is 3-cyclohexyl-methyl-amino-6-methyl-7-anilino fluoran, commercially available under the designation PSD 150 from Nippon Soda Co. Ltd.

To prevent premature coloration of the background, the coating containing the color former and the color developer preferably should be stabilized. In general, this is accomplished by adding a complexing agent, such as polyvinyl pyrrolidone, to the color former, and heating the mixture to a temperature of 60° C. for 15 to 30 min.

When 3-cyclohexyl-methyl-amino-6-methyl-7-anilino fluoran is used as the color former, it can be stabilized against premature color formation by complexing it with polyvinyl pyrrolidone by heating at 60° C. for 15 to 30 minutes. When the solvent-containing capsules are ruptured, a solvent such as diisopropylnaphthalene breaks down the complex and allows the reaction of the color former and the color developer to form the image.

In contrast to a typical self-contained coating, the image formed from the self-contained coating composition of the present invention is sharp and well defined. With the present self-contained coating composition, the color former and color developer are dispersed in the coating and only react on contact with the solvent. When a solution containing a color former and solvent is encapsulated, as in a typical self-contained coating, the color former solution migrates with the solvent and causes image development outside the area of impact. This spreading or wicking contributes to the blurred or enlarged image frequently seen with typical self-contained coatings. In the present invention, both the color former and color developer are fixed in the coating and do not migrate.

The self-contained coating of the present invention is also efficient in its use of expensive color formers. , Because the color reaction takes place only upon contact with the solvent, very little color former or color developer is left unreacted or is carried away into the substrate and wasted.

The use of film formers in the composition, such as polyvinyl alcohol and polyvinyl pyrrolidone, results in a liquid composition which has excellent rheological properties for printing. The rheological properties of the self-contained coating permit it to be spot coated or printed using conventional flexographic equipment. Additionally, the film former aids in maintaining the color former and color developer at the surface of the substrate or sheet so that the color reaction produces a dark, sharp image at the surface thereof.

The use of non-volatile diluents, such as methyl glucoside, in the self-contained coating composition allows the solids content of the wet coating to be maintained at a high level, which permits easy drying and little or no sheet distortion.

The preferred ranges for the components of the self-contained coating used in the business form of the present invention are as indicated: from about 20–50% encapsulated solvent; from about 3–25% color former dispersion; from about 5–20% color developer; from about 1–20% film former; from about 1–20% non-volatile diluent; from about 0.1–1% defoamer; from about 3–20% stilting material; and balance water, all percentages by weight.

A preferred composition to be used in the business form is as follows: 38.6% of a 60% solids dispersion of encapsulated solvent; 15% of a 70% solids dispersion of color former dispersion; 12% color developer; 10% film former; 7.5% non-volatile diluent; 0.5% defoamer; 9% stilting ,material; and balance water, all percentages by weight.

Figure 3:
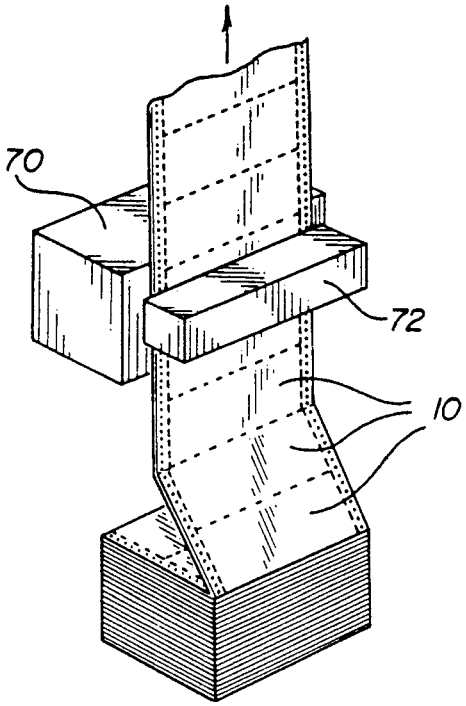
FIG. 3 is a schematic perspective view of an automated printing device for imprinting information onto a continuous multiple sheet business form or mailer made in accordance with one embodiment of the present invention.

FIG. 3 illustrates one method of printing continuous, multi-sheet business forms 10, such as are shown in FIG. 2. The system includes a computer controlled printer 70 having a printer head 72. The business forms are passed between printer head 72 and printer 70. Printer 70 and the feed of business forms 10 can be controlled automatically by the computer.

The images are formed on the sheets by the impact of the printer head 72 on the upper surface of sheet 20 either directly, as shown, or indirectly through a buffer or shield. The shield prevents embossment on sheet 20 caused by the impact of the printer head 72 which can occur in some printers, and protects the printer head 72 from becoming clogged with the self-contained composition. The shield can be an endless loop of woven fabric or synthetic material which passes between printer head 72 and business forms 10 during the printing operation, but which does not contain any pressure-transferable material used to form a colored marking, such as carbon or chromogen.

Visible images are formed on sheets 20, 40, and 60 by either direct or indirect impact on the coatings 30, 32, and 34. No visible image is formed on any sheet outside the area covered by the self-contained coatings.

Self-contained coatings 32 and 34 on inner sheets 40 and 60 can be replaced by other image-forming systems. Carbon spots can be formed on the lower surface of sheets 20 and 40, or placed on separately interleaved sheets, to form visible images on inner sheets 40 and 60, respectively. In addition, a typical carbonless transfer coating may be used on adjacent sheets to form an image on the inner sheets. Self-contained coating 34 may also take the form of a transfer medium, such as a carbon spot, a color developer, or a color former, on the lower surface of sheet 40.

Figure 4:
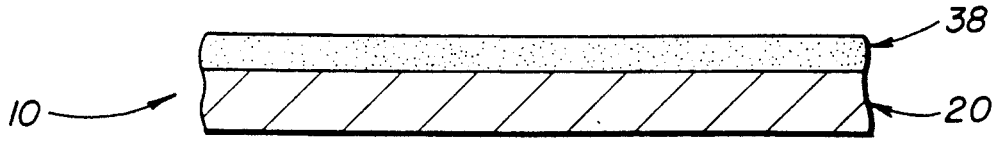
FIG. 4 is a fragmentary sectional view of another embodiment of the business form of the present invention.

FIG. 4 shows another embodiment of the present invention in which the substrate 20 has at least one coating 38 comprising an admixture of a color former and a color developer. In this embodiment, a visible image is formed on first surface 22 of substrate 20 when a solvent for the color former and/or color developer is transferred from the print ribbon of an imaging device to the coating 38. Coating 38 may be selectively applied to portions of first surface 22 so that when the imaging device applies pressure to an area outside of the area covered by coating 38, no image is formed on first surface 22 of substrate 20.

The coating contains the same type of color formers and color developers as discussed in relation to the self-contained coating. The coating may also contain the same types of film formers and non-volatile diluents discussed above.

A preferred composition is as follows: 37.0% of a 70% solids color former dispersion; 15.0% water; 8.0% polyvinyl pyrrolidone, 10.9% polyvinyl alcohol as a film former; and 35.0% of a 40% solids dispersion of color developer, all percentages by weight.

The advantage of this coating is that it contains very high levels of color forming materials, since the need for encapsulated components and stilting material is eliminated. This allows for a lower coat weight, permitting easy drying with no sheet distortion. Any solvent which will solubilize either the color former or the color developer can be used in the print ribbon. However, the selection of solvents having a low vapor pressure is preferred to provide for longevity in the exposed print ribbon. Among the solvents suitable for this use are diisopropylnaphthalene, available from Kreha under the designation KMC-113, dimethylazeolate, N-ethyl-o,p-toluenesulfonamide, available from Monsanto Chemical Co. under the designation Santicizer-8, methyl linoleate, dipropylene glycol dibenzoate, available from Velsicol Chemical Co. under the designation Benzo Flex, linear alkyl benzene with $C_{13}$ to $C_{15}$ alkyl groups, available from Monsanto Chemical Co. under the designation Alkylate 215, alkyl biphenyl, available from Koch Chemical Co. under the designation Suresol 330, and dibutylethyl adipate. Two or more of these solvents may be blended together to take advantage of the desirable properties of the solvents.

Figure 5:
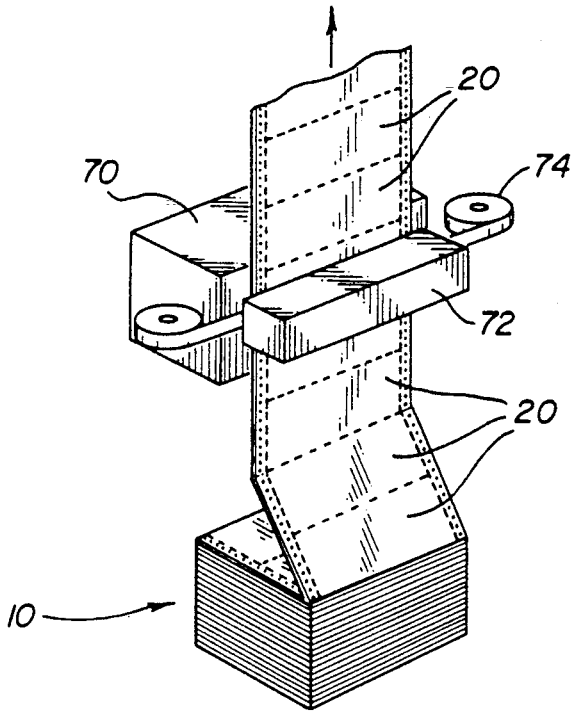
FIG. 5 is a schematic perspective view of an automated printing device for imprinting information onto a continuous multiple sheet business form or mailer made in accordance with another embodiment of the present invention.

FIG. 5 illustrates one method of printing business forms 10, such as are shown in FIG. 4. The system includes a computer controlled printer 70 having a printer head 72 and a ribbon 74 carrying a solvent. The business forms 10 are passed between printer head 72 and printer 70. Printer 70 and the feed of business forms 10 can be controlled automatically by the computer.

With this embodiment of the invention, the images are formed on sheet 20 of business form 10 by the impact of printer head 72 and print ribbon 74 directly on first surface 22 of sheet 20. The print ribbon 74 contains a solvent which dissolves the color formers and/or color developers permitting them to react to form a visible image when printer head 72 impacts sheet 20. If a multiple sheet business form is needed, other image-forming systems, such as self-contained compositions, should be used on the other sheets, since the solvent in the print ribbon 74 will only contact coating 38 on first surface 22 of sheet 20.

Figure 6:
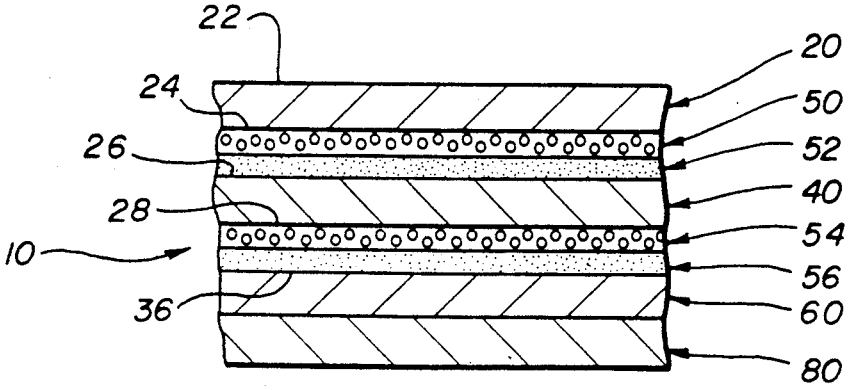
FIG. 6 a fragmentary sectional view of another embodiment of the multiple sheet business form of the present invention.

FIG. 6 illustrates still another embodiment of the multiple sheet business form of the present invention in which one or more of the sheets in the stack has pressure-rupturable microcapsules containing a solvent coated on the back side thereof. The adjacent sheet has an admixture of a color former and a color developer coated on the front surface thereof.

As shown, and where like reference numerals refer to like elements, sheet 20 has a coating 50 on its lower surface 24 of pressure-rupturable microcapsules containing a solvent. Sheet 40 has a coating 52 on its upper surface 26 containing an admixture of a color former and a color developer. The lower surface 28 of sheet 40 has a coating 54 of pressure-rupturable microcapsules containing a solvent, and the upper surface 36 of sheet 60 has a coating 56 containing an admixture of a color former and a color developer. When the form 10 is impacted by an imaging device, the microcapsules in coating 50 will be ruptured and solvent will be expressed onto coating 52 allowing the reaction of the color former and the color developer to occur. Additional sheets in the form may also be coated in this manner.

Coatings 50 and 52, and 54 and 56 may be coated so that the coatings are not coextensive. In this way, an imaging device contacting first surface 22 of sheet 20 outside of coatings 50 and 52 will not form an image on sheet 40 but will form an image on sheet 60 if the impact occurs within the area covered by coatings 54 and 56. By selectively coating the surfaces of sheets 20, 40, and 60, all printing of information can be done in a single pass.

Figure 7:
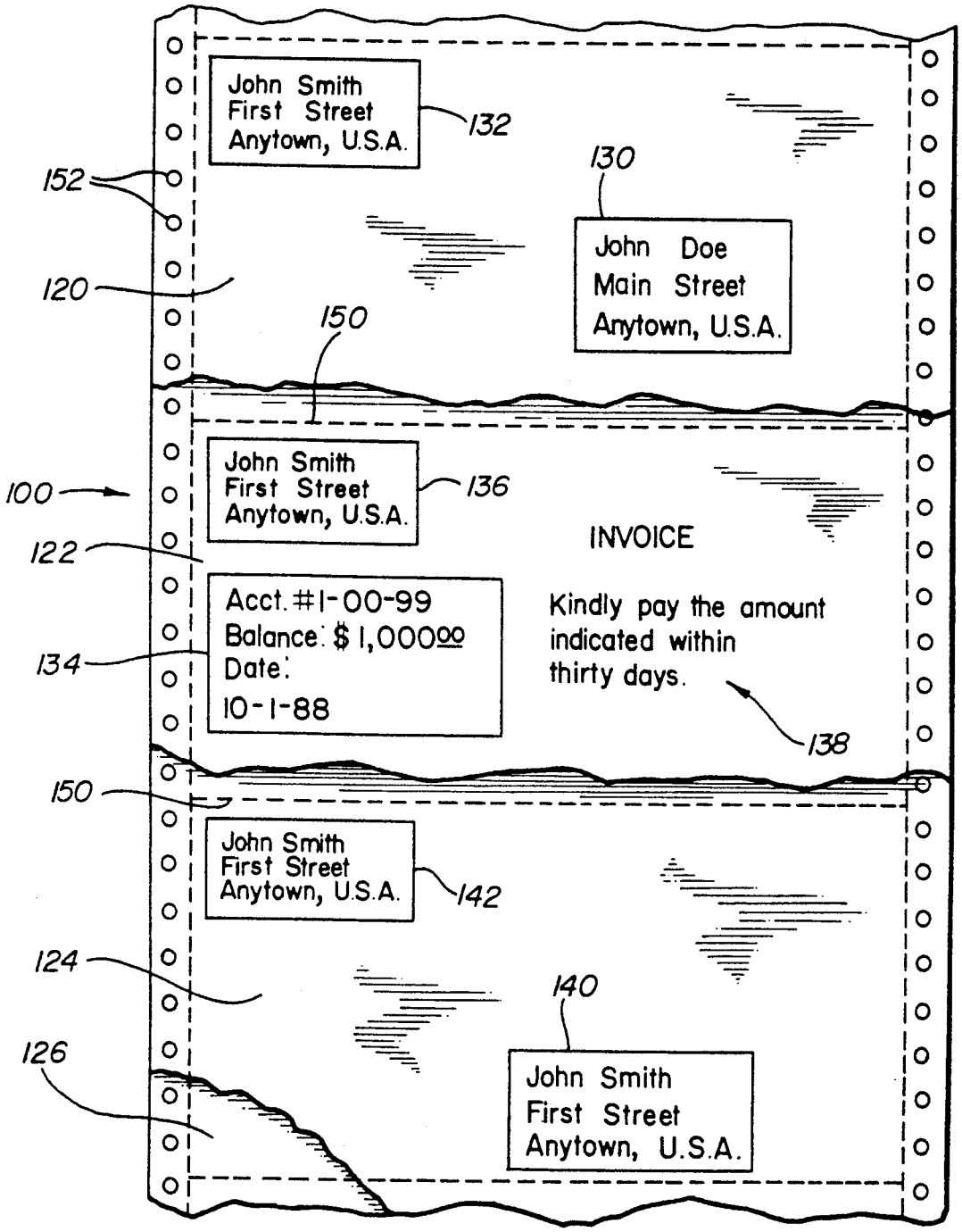
FIG. 7 is a front elevation view, partially in section, of a multiple sheet business form of the present invention.

FIG. 7 shows a typical use of the multiple sheet business form or mailer of the present invention. All of the information can be printed on the sheets in a single pass of the form through the printing apparatus as shown in FIG. 3 or 5. The mailers are formed from continuous sheets which are attached together and which can be separated into individual envelopes by perforations 150. Prepunched holes 152 along the margins of the form are used to guide the continuous form through the printer.

The form 100 shown in FIG. 7 contains an outer envelope, an invoice, and a return envelope. The outer envelope is formed by top sheet 120 and back sheet 126 which are sealed together along their adjacent peripheral edges. Top sheet 120 forms the front face of the outer envelope and has localized self-contained coatings 130 and 132 for the customer's address and sender's return address, respectively. Other localized coated areas may be provided for additional information to be printed on the outer envelope.

Sheet 122 is the customer s invoice. Coating 134 covers that portion of the surface area of sheet 122 needed for the confidential billing information. Coating 136 provides an area for the sender's name and address to be printed. Additional information, indicated at 138, may be preprinted on the sheet prior to the joinder of the sheets into the form. Because coating 130 on sheet 120 is not coextensive with coating 134 on sheet 122, the impact needed to print the confidential billing information on sheet 122 occurs outside of the coatings on sheet 120. Therefore, the images for the confidential billing information will appear only on the inner sheets of the mailer and not on the outer envelope. However, as coatings 132 and 136 are coextensive, that information will appear on both sheets.

Sheets 124 and 126 form the return envelope. Spot coatings 140 and 142 on sheet 124 allow any necessary or desired printing, such as return address information, to be done on the return envelope. Again coating 140 is not coextensive with coatings on any of the other sheets so this information will appear only on sheet 124.

Figure 8:
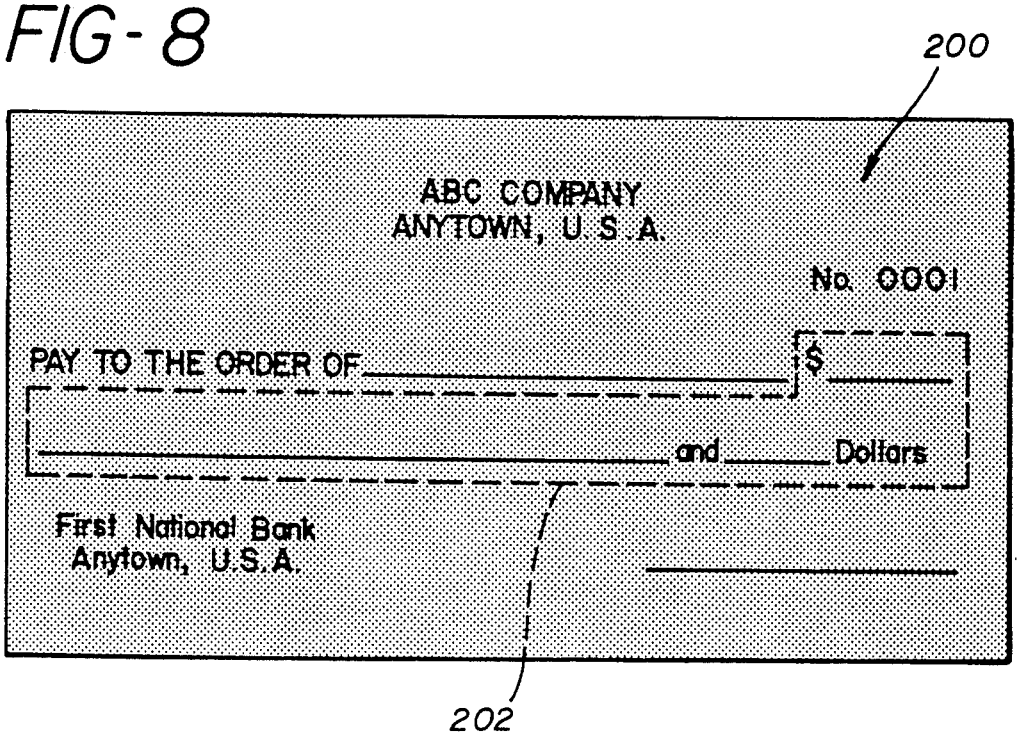
FIG. 8 is a front elevation view of a security document containing a covert warning phrase (shown in phantom outline) beneath an area where alteration may be attempted.

FIG. 8 illustrates a security document 200 produced according to the present invention. The security document is illustrated as a check. However, the document may be any kind of document which itself has value or which indicates value. The document includes an area 202, indicated in phantom lines, where a covert coating has been applied. The coating may be either a self-contained coating comprising an admixture of a color former, a color developer, and a plurality of pressure-rupturable microcapsules containing a solvent, or it may be a coating comprising an admixture of a color former and a color developer.

The types of color formers, color developers, and film formers which can be used have been discussed above. The preferred composition comprises 37.6 (wet parts by weight) encapsulated diisopropylnaphthalene, 3.4 parts water, 0.5 parts defoamer, 15.0 parts color former dispersion, 7.5 parts alpha methyl glucoside, 10 parts 20% polyvinyl alcohol in water solution, 12 parts phenolic dispersion, and 9 parts corn starch stilting material.

If a self-contained coating is utilized, any attempted alteration by erasure or rubbing of any writing printed within this area will rupture the microcapsules containing the solvent and cause a color to form due to the reaction between the color former and the color developer. In addition, any attempted alteration using solvents will cause a reaction between the color former and the color developer. If the coating contains only the admixture of color former, and color developer, then the coating will only be able to detect solvent alteration, not alteration by erasure.

The security coating will show attempted alteration on the document by the use of many solvents in the following classes: alcohols, acetates, ketones, chlorinated hydrocarbons, furans, mineral acids, and some organic acids. In addition, the self-contained coating may include a hypochlorite sensitive compound such as diphenyl guanidine which forms a color upon exposure to ink eradicators to further improve the range of security against unauthorized alteration of the document. Diphenyl guanidine is preferably used in conjunction with the color former 2-aminobenzothiazole lithium salt.

The coating is also sensitive to attempted alteration by steam. Since the temperature of steam is above the melting point of typical color developers used in the practice of the present invention, a phase change will occur if alteration is attempted using steam. The liquified color developer will displace the color former/complexing agent complex, and the color reaction will occur.

In addition, the preferred color former is sufficiently light fast both before and after activation that exposure to ultraviolet light cannot be used to neutralize the security feature.

Printing of an original amount will cause rupture of the microcapsules immediately beneath the writing. However, that color change will not be apparent because the writing will cover it. Only when erasure of the original amount is attempted outside of the area of the original writing will the color change be perceived. The security document may also be printed to contain a warning that the background of the document is a certain color. The color change in area 202 will alert the receiver of the document that an alteration has been attempted. It will be appreciated that with the Patent and Trademark Office requirements that drawings be in black and white only, the color change cannot be depicted as it will actually appear.

Figure 9:
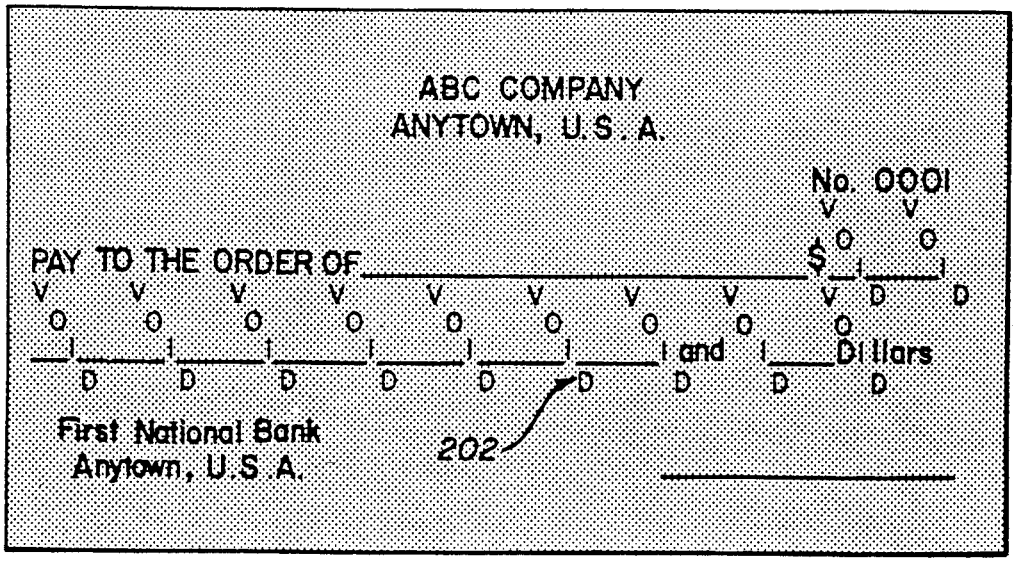
FIG. 9 is a front elevation view of the security document of FIG. 8 illustrating the appearance of the warning phrase after alteration has been attempted.

FIG. 9 illustrates an alternative embodiment in which the coating in area 202 has been printed as a covert image, in this instance the warning phrase VOID. FIG. 9 depicts the result when the entire area has been subjected to attempted alteration. The warning phrase appears repeated within area 202 in a color which is different from the original background color of the document.

The ability to print images and words is an important advantage of the present invention. It eliminates the need to rely on the knowledge of clerks and cashiers concerning the meaning of the speckles of the conventional solvent sensitive documents. The images and words are readily apparent, as is their meaning.

In actual practice, alteration may be attempted in only a limited portion of area 202. In such instance, the warning phrase, in a color different from the background color of the document, will appear only in that portion where pressure or solvent has been applied.

Figure 10:
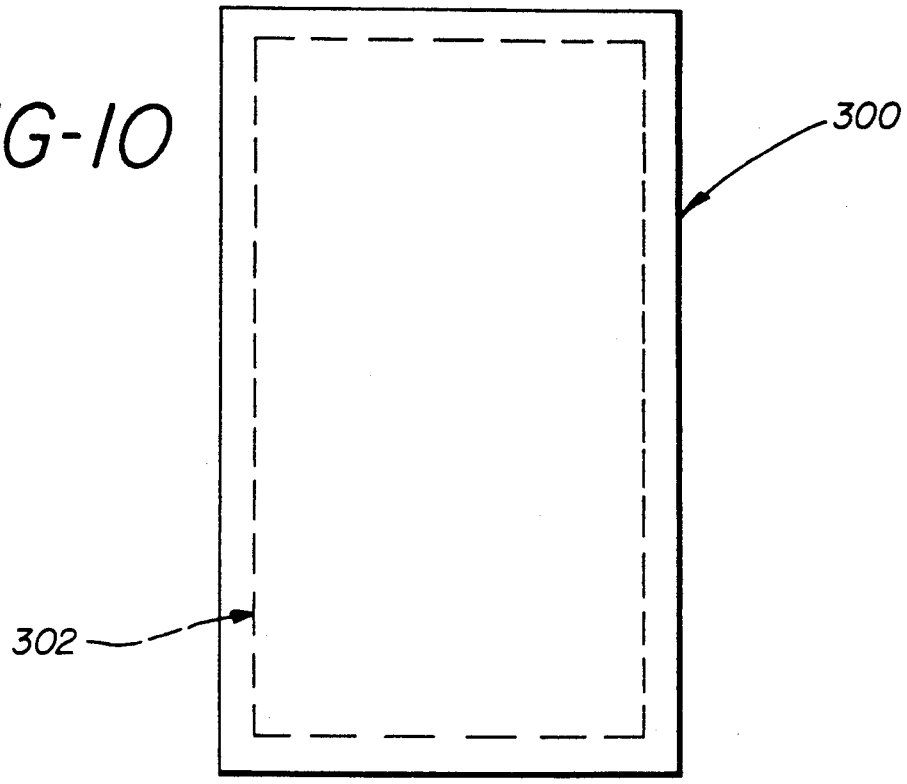
FIG. 10 is a front elevation view, partially in section, of a safety paper containing a covert warning phrase (shown in phantom outline) beneath substantially all of the surface of the paper.

FIG. 10 illustrates a safety paper 300 produced according to the present invention. Substantially all of the surface of the paper is covered by covert coating 302. The coating may be either a self-contained coating comprising an admixture of a color former, a color developer, and a plurality of pressure-rupturable microcapsules containing a solvent, or it may be a coating comprising an admixture of a color former and a color developer.

If it is a self-contained coating, any attempted alteration by erasure or rubbing of any writing printed within this area will rupture the microcapsules containing the solvent and cause a color to form due to the reaction between the color former and the color developer. In addition, any attempted alteration using solvents will cause a reaction between the color former and color developer. If the coating contains only an admixture of color former and color developer, then the coating will only be able to detect solvent alteration, not alteration by erasure.

The safety paper will show attempted alteration of the document by the use of many solvents in the following classes: alcohols, acetates, ketones, chlorinated hydrocarbons, furans, mineral acids, and some organic acids. In addition, the self-contained coating may include a hypochlorite sensitive compound which forms a color upon exposure to ink eradicators to further improve the range of security against unauthorized alteration of the document.

Figure 11:
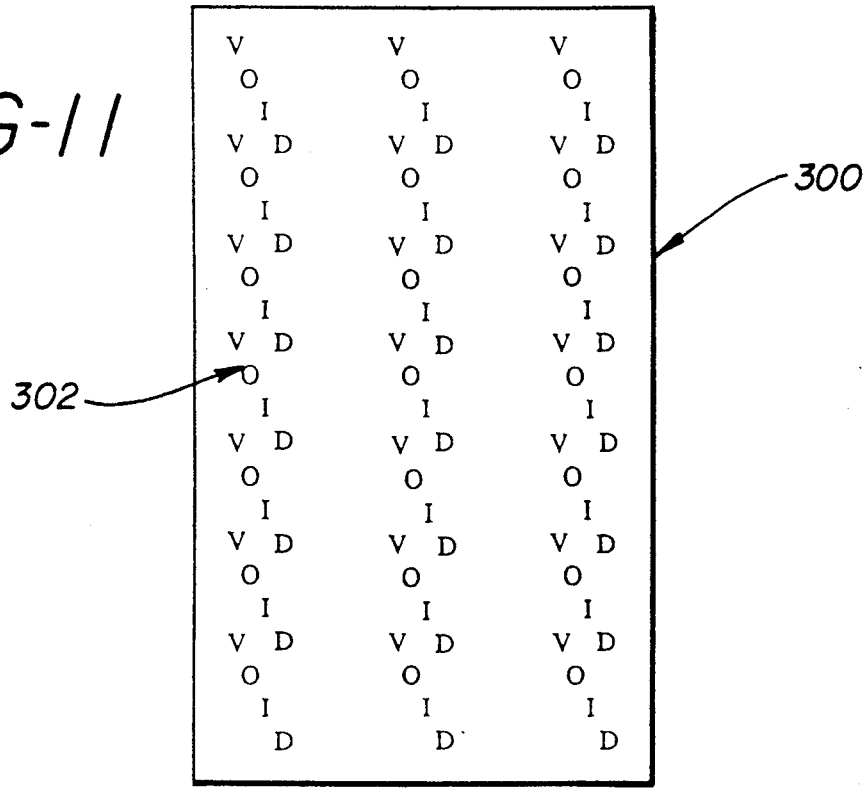
FIG. 11 is a front elevation view, of the safety paper of FIG. 10 illustrating the appearance of the warning phrase after alteration has been attempted.

FIG. 11 illustrates an alternative embodiment in which the coating in area 302 has been printed as a covert image, in this instance the warning phrase VOID. FIG. 11 depicts the result when the entire area has been subjected to attempted alteration. In actual practice, alteration may be attempted in only a limited portion of coating 302. In such instance, the warning phrase will appear only in that portion where pressure or solvent has been applied.

In order that the invention may be more readily understood, reference is made to the following examples, which are intended to be illustrative of the invention, but are not intended to be limiting in scope.

EXAMPLE 1

A dispersion of a color former was prepared by charging a 500 gm jacketed attritor with 39.5% water, 0.5% Wacker Silicones SWS 213, and 10.0% GAF K30 polyvinyl pyrrolidone. (All percentages by weight.) The attritor was operated at a speed which caused a vortex to form. When this solution was homogenous, 50.0% Nippon Soda Co. Ltd. PSD 150 dye was added. The dispersion was then milled in the attritor until the average particle size of the dye was measured to be approximately 2 to 5 microns using a Coulter Counter.

The following ingredients were then combined with stirring:

| | Wet Parts By Weight |
|---|---|
| Micronal SE 0201[1] | 38.8 |
| Water | 7.2 |
| SWS 213[2] | 0.5 |
| Color former dispersion[3] | 15.0 |
| Stameg 104[4] | 7.5 |
| This mixture was heated to 60° C. with stirring. | |
| K30[5] | 10.0 |

was added, and the mixture was maintained at 60° C. for 15 to 30 min. It was then cooled to 35° C. minimum, and the following were mixed in to produce a self-contained coating for use in business forms in accordance with the present invention:

| | |
|---|---|
| HRJ 10126[6] | 12.0 |
| 3005[7] | 9.0 |

[1]Encapsulated diisopropylnaphthalene from BASF.
[2]A defoamer from Wacker Silicones.
[3]The color former dispersion made above.
[4]An alpha methyl glucoside non-volatile diluent available from Horizon Chemical Co.
[5]A polyvinyl pyrrolidone available from GAF Corp.
[6]A phenolic dispersion from Schenectady Chemicals.
[7]A corn starch stilting material available from Corn Products.

EXAMPLE 2

The procedure of Example 1 was followed to produce the color former dispersion using the following ingredients:

| | Wet Parts By Weight |
|---|---|
| Sodium caseinate | 1.3 |
| K30[1] | 1.1 |
| Water | 28.0 |
| SWS 213[2] | .2 |
| PSD 150[3] | 69.4 |

[1]A polyvinyl pyrrolidone available from GAF Corp.
[2]A defoamer from Wacker Silicones.
[3]3-cyclohexyl-methyl-amino-6-methyl-7-anilino fluoran, from Nippon Soda Co. Ltd.

The color former dispersion was then combined with additional materials as in Example 1 to produce a self-contained coating for use in business forms.

EXAMPLE 3

The procedure of Example 1 was followed with the following ingredients to produce a self-contained coating for use in business forms:

| | Wet Parts By Weight |
|---|---|
| Micronal SE 0201[1] | 37.6 |
| Water | 3.4 |
| SWS 213[2] | 0.5 |
| Color former dispersion[3] | 15.0 |
| Stameg 104[4] | 7.5 |
| K30[5] | 5.0 |
| 20% Vinol 205[6] in water solution | 10.0 |
| HRJ 10126[7] | 12.0 |

-continued

| | Wet Parts By Weight |
|---|---|
| 3005[8] | 9.0 |

[1]Encapsulated diisopropylnaphthalene from BASF.
[2]A defoamer from Wacker Silicones.
[3]The color former dispersion made in Example 1.
[4]An alpha methyl glucoside non-volatile diluent available from Horizon Chemical Co.
[5]A polyvinyl pyrrolidone available from GAF Corp.
[6]A polyvinyl alcohol film former from Air Products. This was added with the phenolic dispersion and the corn starch after the mixture was cooled.
[7]A phenolic dispersion from Schenectady Chemicals.
[8]A corn starch stilting material available from Corn Products.

The coatings of Examples 1 and 3 were applied to 18# carbonizing bond paper at coating weights of 1.5 lb/ream (17×22×500). The coatings were applied by spot coating using offset gravure with a 95Q, 32 BCM anilox roll and dried using infrared heaters.

EXAMPLE 4

A dispersion of a color former was prepared by charging a 600 gm jacketed attritor with 180 gm water, 20 gm GAF K30 polyvinyl pyrrolidone, and 200 gm Nippon Soda Co. Ltd. PSD 150 dye. One half of the volume of the attritor was filled with ⅛" stainless steel media. The attritor was operated at 60% speed for 4 hours. The average particle size of a sample was measured to be approximately 3 to 5 microns using a Coulter Counter.

The following ingredients were then combined with stirring:

| | Wet Parts By Weight |
|---|---|
| Color former dispersion[1] | 36.1 |
| Water | 15.0 |
| K30[2] | 8.0 |

This mixture was heated to 60° C. with stirring and maintained at that temperature for 15 to 30 min. It was then cooled to 35° C., and the water lost in the heating was replaced.

| | |
|---|---|
| 20% Vinol 205[3] solution in water | 10.9 |

was added, and the mixture was allowed to cool to room temperature.

| | |
|---|---|
| HRJ 10126[4] | 30.0 |

was added to produce a coating in accordance with the present invention for use with a ribbon saturated with an oily solvent.

[1]The color former dispersion from Example 1.
[2]A polyvinyl pyrrolidone available from GAF Corp.
[3]A polyvinyl alcohol film former from Air Products.
[4]A phenolic dispersion from Schenectady Chemicals.

The coating of Example 3 was applied to 18-lb carbonizing bond paper at a coating weight of 0.7 lb/ream by offset gravure with a 150Q anilox roll and dried by infrared. It was used with a print ribbon containing a mixture of 50% Suresol 330, and 50% dibutylethyl adipate.

EXAMPLE 5

A dispersion of a color former was prepared by charging a 500 gm jacketed attritor with 39.5% water, 0.5% Wacker Silicones SWS 213, and 10.0% GAF K30 polyvinyl pyrrolidone. (All percentages by weight.) The attritor was operated at a speed which caused a vortex to form and 50.0% Nippon Soda Co. Ltd. PSD 150 dye was added. The dispersion was then milled in the attritor until the average particle size of the dye was measured to be approximately 3 to 5 microns using a Coulter Counter.

The following ingredients were then combined:

| | Wet Parts By Weight |
|---|---|
| Color former dispersion[1] | 33.0 |
| Water | 15.0 |
| 20% Vinol 205[2] solution in water | 25.0 |
| K30[3] | 7.0 |

This mixture was heated to 60° C. with stirring and maintained at that temperature for 15 to 30 min. It was then cooled to 30° C.

| | |
|---|---|
| HRJ 10126[4] | 20.0 |

was added to produce a coating in accordance with the present invention for use in a security document.

[1]The color former dispersion made above.
[2]A polyvinyl alcohol film former from Air Products.
[3]A polyvinyl pyrrolidone available from GAF Corp.
[4]A phenolic dispersion from Schenectady Chemicals.

The coating was applied to 24-lb. bond paper at a coating weight of 0.7 lb/ream with a Geiger proof press using a 180Q anilox roll with a reverse angle doctor blade. The printing plate was in the form of jumbled characters. The resulting print was difficult to see, but it developed into well defined jumbled characters when swabbed with the solvent ethyl acetate. Other active solvents include ketones, chlorinated hydrocarbons, alcohols and esters.

EXAMPLE 6

The following ingredients were combined according to the procedure of Example 5 to produce a coating in accordance with the present invention for use in a security document:

| | Wet Parts By Weight |
|---|---|
| Color former dispersion[1] | 30.0 |
| 20% Vinol 205[2] solution in water | 35.0 |
| K30[3] | 7.0 |
| HRJ 10126[4] | 13.0 |
| Chlorostain OR concentrate[5] | 5.0 |
| Water | 10.0 |

[1]The color former dispersion made in Example 5.
[2]A polyvinyl alcohol film former from Air Products.
[3]A polyvinyl pyrrolidone available from GAF Corp.
[4]A phenolic dispersion from Schenectady Chemicals.
[5]A hypochlorite sensitive compound from Mobay Chemical Co. It was added with the phenolic dispersion after cooling.

EXAMPLE 7

The following ingredients were combined according to the procedure of Example 5 to produce a coating in accordance with the present invention for use in a security document:

| | Wet Parts By Weight |
|---|---|
| Color former dispersion[1] | 30.0 |
| 20% Vinol 205[2] solution in water | 45.0 |
| K30[3] | 7.0 |
| HRJ 10126[4] | 13.0 |
| Chlorostain OR[5] | 5.0 |

[1]The color former dispersion made in Example 5.
[2]A polyvinyl alcohol film former from Air Products.
[3]A polyvinyl pyrrolidone available from GAF Corp.
[4]A phenolic dispersion from Schenectady Chemicals.
[5]A hypochlorite sensitive compound from Mobay Chemical Co. It was added with the phenolic dispersion after cooling.

A CB coating for use with the CF coating of Example 7 was prepared by mixing together with mild stirring:

| | Wet Parts By Weight |
|---|---|
| Micronal 201[1] | 10.0 |
| K30 | 7.0 |
| Water | 13.0 |

[1]A capsule dispersion made by BASF in which the capsules contain solvent only.

The mixture was heated to 60° C. for 30 minutes, then cooled to 25° C. The following were then added with mild stirring:

| | |
|---|---|
| 20% ammonium caseinate solution in water | 20.0 |
| 20% Vinol 205[1] solution in water | 10.0 |
| HRJ 10138 | 20.0 |

[1]A polyvinyl alcohol film former from Air Products.

The coating was applied to 15# bond paper at a coating weight of 0.7 lb/ream by offset gravure with a 150Q anilox roll and dried by infrared.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A business form comprising:

at least one substrate having a first and second major surface, and having a self-contained coating composition on at least a portion of one of said major surfaces, said self-contained coating composition comprising an admixture of a color former which is stabilized with a complexing agent to prevent premature coloration, a color developer, and a plurality of pressure-rupturable microcapsules containing a solvent, said self-contained coating composition being adapted to release said solvent from said microcapsules upon the impact of the imaging device, to permit reaction of said color former and said color developer to form a visible color.

2. The business form of claim 1 wherein said color developer is a phenolic resin.

3. The business form of claim 2 wherein said phenolic resin contains an alkyl salicyclic acid.

4. The business form of claim 1 wherein said solvent is diisopropylnaphthalene.

5. The business form of claim 1 wherein said color former is a leuco dye.

6. The business form of claim 1 wherein said color former is 3-cyclohexyl-methyl-amino-6-methyl-7-anilino fluoran.

7. The business form of claim 1 wherein said complexing agent is polyvinyl pyrrolidone.

8. The business form of claim 1 wherein said self-contained coating composition includes a film forming composition.

9. The business form of claim 8 wherein said film forming composition is selected from the group consisting of polyvinyl pyrrolidone, polyvinyl alcohol, and mixtures thereof.

10. The business form of claim 1 wherein said self-contained coating composition includes a non-volatile diluent.

11. The business form of claim 10 wherein said non-volatile diluent is methyl glucoside.

12. The business form of claim 1 further comprising a plurality of sheets in a stacked relationship and wherein said self-contained coating composition is coated on the top sheet.

13. The business form of claim 12 wherein at least one underlying sheet has a second self-contained coating composition on at least a portion of one of said major surfaces, said second self-contained coating composition comprising an admixture of a color former, a color developer, and a plurality of pressure-rupturable microcapsules containing a solvent, said first and said second self-contained coating compositions being non-coextensive.

14. A method for forming visible images on a business form having a first and a second major surface and having a self-contained coating composition on at least a protein of one of said major surfaces, said self-contained coating composition comprising an admixture of a color former which is stabilized with a complexing agent to prevent premature coloration, a color developer, and a plurality of pressure-rupturable microcapsules containing a solvent, which comprises the step of containing said surface of said business form with an imaging device thereby providing a visible image in said self-contained coating composition by rupturing said microcapsules to release said solvent causing reaction of said color former with said color developer.

15. The method of claim 14 wherein the business form further comprises a plurality of sheets in a stacked relationship wherein said self-contained coating composition is coated on the top sheet and wherein at least one underlying sheet has a second self-contained coating composition on its upper surface, said second self-contained coating composition comprising an admixture of a color former, a color developer, and a plurality of pressure-rupturable microcapsules containing a solvent, said first and said second self-contained coating compositions being non-coextensive.

16. The method of claim 14 wherein said imaging device directly contacts said self-contained coating composition.

17. The method of claim 14 further comprising placing a non-reactive shielding means between said imaging device and said self-contained coating composition to reduce the impact of said imaging device on said major surface of said substrate.

18. The method of claim 14 wherein said complexing agent is polyvinyl pyrrolidone.

19. A business form comprising at least one substrate having a first and second major surface and having a coating composition on at least a portion of one of said major surfaces, said coating composition comprising an admixture of a color former which is stabilized with a complexing agent to prevent premature coloration, a micro encapsulated solvent and a color developer, said color former and said color developer being adapted to reactively combine to form a visible color upon contact by said solvent.

20. The business form of claim 19 wherein said complexing agent is polyvinyl pyrrolidone.

21. The business form of claim 19 wherein said solvent is contained in pressure rupturable microcapsules included in said coating composition, said coating composition being adapted to release said solvent from said microcapsules upon impact from an imaging device such that said color former and said color developer reactively combine to form said visible color.

22. The business form of claim 21 wherein said microcapsules range in size from 3 to 7 microns.

23. The business form of claim 19 wherein said solvent is contained in pressure rupturable microcapsules contained in a second coating composition on the surface of a second substrate adjacent said first substrate, said second coating composition and said first coating composition facing one another such that solvent from said microcapsules is released upon impact from an imaging device to contact said color former and said color developer, thereby causing said color former and said color developer to reactively combine to form said visible color.

24. The business form of claim 19 wherein said color former is a leuco dye.

25. The business form of claim 19 wherein said color developer is a phenolic resin.

* * * * *